US009334136B2

(12) United States Patent
Corsico Piccolino

(10) Patent No.: US 9,334,136 B2
(45) Date of Patent: May 10, 2016

(54) UNROLLING DEVICE, PARTICULARLY FOR MATERIALS IN ROLLS, WITH MATERIAL ALIGNMENT CONTROL

(75) Inventor: Alessandro Corsico Piccolino, Vigevano (IT)

(73) Assignee: COMELZ S.P.A., Vigevano (IT)

( * ) Notice: Subject to any disclaimer, the term of this patent is extended or adjusted under 35 U.S.C. 154(b) by 148 days.

(21) Appl. No.: 14/117,707

(22) PCT Filed: Mar. 30, 2012

(86) PCT No.: PCT/EP2012/055783
§ 371 (c)(1),
(2), (4) Date: Nov. 14, 2013

(87) PCT Pub. No.: WO2012/159808
PCT Pub. Date: Nov. 29, 2012

(65) Prior Publication Data

US 2014/0124609 A1 May 8, 2014

(30) Foreign Application Priority Data

May 23, 2011 (IT) ..... MI2011A0911

(51) Int. Cl.

| | |
|---|---|
| ***B65H 18/08*** | (2006.01) |
| ***B65H 16/02*** | (2006.01) |
| ***B65H 16/08*** | (2006.01) |
| ***B65H 23/032*** | (2006.01) |

(52) U.S. Cl.
CPC ..... *B65H 16/026* (2013.01); *B65H 16/08* (2013.01); *B65H 23/032* (2013.01); *B65H 23/0326* (2013.01); *B65H 2551/23* (2013.01); *B65H 2551/29* (2013.01)

(58) Field of Classification Search
CPC ..... B65H 16/02; B65H 23/032
USPC ..... 242/563.1, 534.1
See application file for complete search history.

(56) References Cited

U.S. PATENT DOCUMENTS

| | | | | |
|---|---|---|---|---|
| 1,515,289 | A | | 11/1924 | Tullis |
| 1,631,405 | A | | 6/1927 | Downing |
| 3,556,425 | A | * | 1/1971 | Keesling et al. ..... 242/534.1 |
| 3,782,649 | A | * | 1/1974 | Frederick et al. ..... 242/418.1 |
| 4,054,251 | A | | 10/1977 | Henderson et al. |
| 4,077,579 | A | | 3/1978 | Seleski et al. |
| 4,384,686 | A | | 5/1983 | Wiley et al. |
| 4,461,431 | A | | 7/1984 | Wiley et al. |

FOREIGN PATENT DOCUMENTS

CN 101678977 A 3/2010

OTHER PUBLICATIONS

International Search Report and Written Opinion dated Jun. 22, 2012 issued in PCT/EP2012/055783.
Chinese Office Action dated Mar. 16, 2015 received from Application No. 201280023864.4, together with an English-language translation.

* cited by examiner

*Primary Examiner* — Sang Kim
(74) *Attorney, Agent, or Firm* — Scully, Scott, Murphy & Presser, P.C.

(57) ABSTRACT

An unrolling device, particularly for materials in rolls, with material alignment control, comprising elements for unrolling a roll of material to be unrolled, the device further comprising elements for detecting at least one lateral edge of the material unrolled from the roll which are adapted to detect quantitatively the movement of the edge transversely to the unrolling direction of the material.

8 Claims, 1 Drawing Sheet

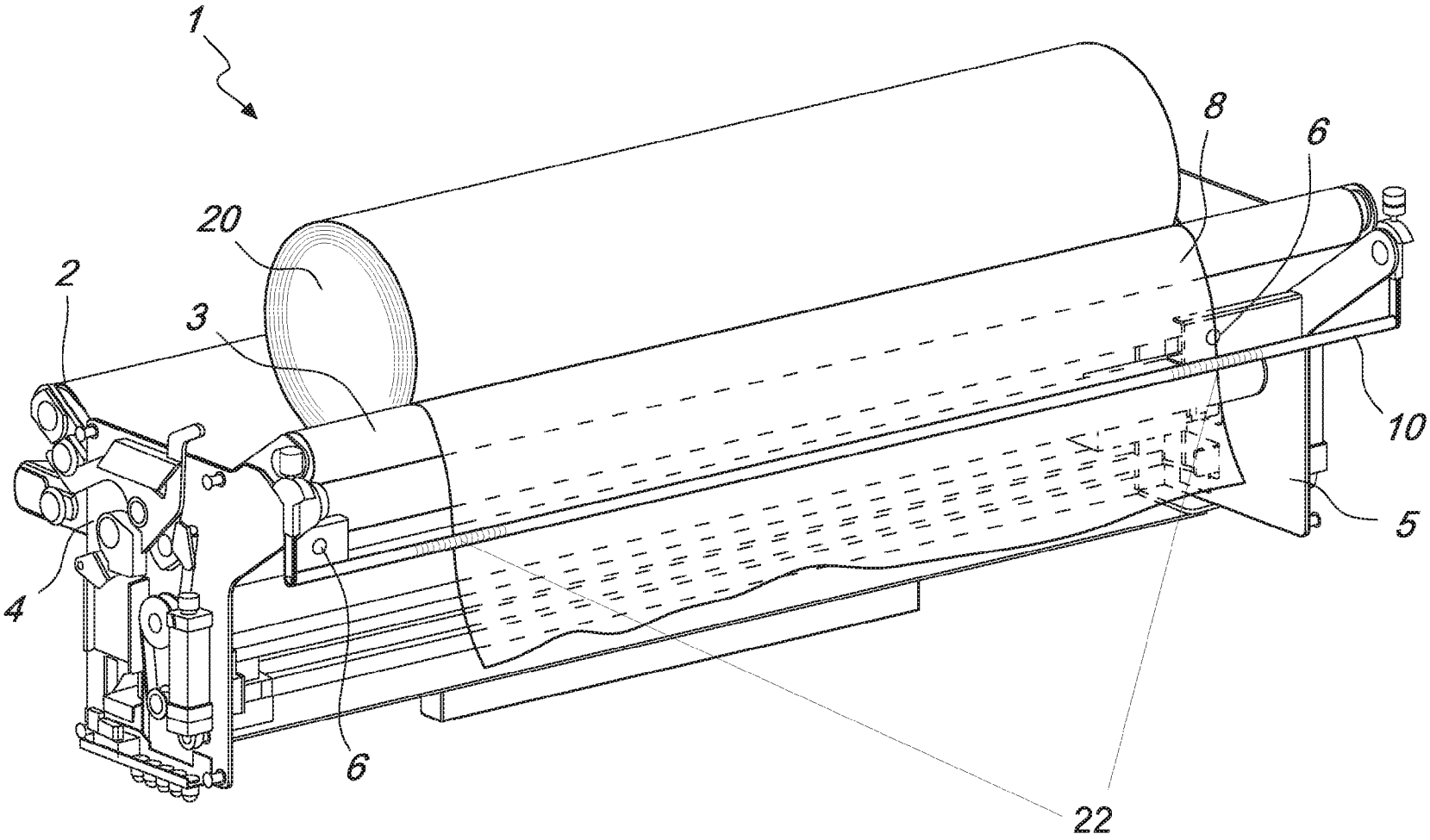
1
2
3
4
5
6
6
8
8
10
20
22

UNROLLING DEVICE, PARTICULARLY FOR MATERIALS IN ROLLS, WITH MATERIAL ALIGNMENT CONTROL

The present invention relates to an unrolling device, particularly for materials in rolls, with material alignment control. More particularly, the invention relates to an unrolling device for materials in rolls, particularly in systems for unrolling fabrics or other materials in rolls in order to deposit them, in a single layer or in multiple layers, on a preparation table or directly on the worktable of a cutting machine, so as to keep them aligned and tension-free.

As is known, in systems for unrolling fabrics or other materials in rolls, devices particularly known as unrolling devices are provided, which accommodate the roll of material, which is rested in a V-shaped cradle constituted by two synchronous conveyor belts (or rollers) (or is supported and rotated axially). The unrolling device can not only turn the roll to unroll the material but also move such roll laterally, during its unrolling, so as to keep the material spread on the table aligned, thus correcting the distortions and misalignments of the material wound on the roll.

In order to control with feedback the lateral movement of the roll, usually a sensor is used which is generally an optical one of the on/off type, is arranged at one of the lateral edges of the material and detects the oscillation of the outgoing material.

The feedback control system described above is of the closed-loop type and is subject to the limitations caused by the response times of the feedback loop and by the speed and resolution of the commands, which can entail instabilities or oscillations of the control.

Conventional unrolling devices deposit the material, according to the different cases, by moving along fixed preparation or working surfaces or directly on a conveyor belt, with synchronous unrolling speed.

If the material is deposited directly onto the working surface, it is necessary to establish a lateral reference alignment between the edge of the material and the cutting area of such material.

The aim of the present invention is to provide a device for unrolling material in rolls, with material alignment control, that allows to determine quantitatively the movement of the lateral edge of the material unrolled by the unrolling device.

Within this aim, an object of the present invention is to provide an unrolling device that allows to reduce the lateral waste margins of the material.

Another object of the present invention is to provide an unrolling device that allows to detect automatically the reference lateral alignment between the edge of the material and the cutting area without having to specify it manually for each material.

Another object of the present invention is to provide an unrolling device that allows to detect automatically the starting position (front edge) of the material.

Another object of the present invention is to provide an unrolling device that allows to measure automatically and continuously the exact width of the material unrolled by the unrolling device.

Another object of the present invention is to provide an unrolling device that is highly reliable, relatively simple to provide and at competitive costs.

This aim, as well as these and other objects which will become better apparent hereinafter, are achieved by an unrolling device, particularly for materials in rolls, with alignment control, comprising means for unrolling a roll of material to be unrolled, characterized in that it comprises means for detecting at least one lateral edge of the material unrolled from said roll which are adapted to detect quantitatively the movement of said edge transversely to the unrolling direction of the material.

Further characteristics and advantages of the invention will become better apparent from the description of preferred but not exclusive embodiments of the unrolling device according to the present invention, illustrated by way of non-limiting example in the accompanying drawings, wherein the only FIGURE is a perspective view of the unrolling device according to the invention.

With reference to the FIGURE, the unrolling device according to the invention, generally designated by the reference numeral 1, comprises means for unrolling a roll 20 of material to be unrolled, which comprise for example a pair of conveyor belts or rollers 2 and 3 which are arranged so as to form a V-shaped cradle adapted to accommodate a roll 20 of material to be unrolled.

The two belts or rollers 2 and 3 are driven synchronously.

The rollers 2 and 3 are supported by a pair of lateral shoulders 4 and 5, which define the sides of the device.

As an alternative, the means for unrolling the roll 20 can be constituted by per se known means adapted to impart an axial rotation of the roll 20 for its consequent unrolling.

The particularity of the invention resides in that the device is provided with means adapted to detect quantitatively the lateral movement of the edge of the material in roll that is unrolled.

This movement occurs transversely to the unrolling direction and constitutes the misalignment of the material with respect to an ideal unrolling direction.

In particular, such means can be constituted for example by a plurality of photocells or by a vision system.

The means adapted to detect quantitatively the lateral movement of the edge of the material are designated hereinafter by the reference numeral 6 and are preferably arranged at least at one side of the unrolling device.

The means 6 for quantitative detection of the lateral movement of the edge of the material are arranged so that the material unrolled from the roll passes in front of them and between the detection device and means 10 for indicating the lateral movement, which are conveniently constituted for example by a rod-like element pivoted at the shoulders 4 and 5 of the device and are adapted to bear, at their portion that coincides with the position in which the edge of the unrolled material is located, a graduated scale 22 which allows the detection means to quantify the lateral movement of the edge of the material.

Conveniently, a single detection means can be provided which is therefore arranged at one end of the unrolling device, at the edge of the material to be unrolled, or there can be a pair of detection means, arranged at the opposite ends of the unrolling device, therefore each one at one of the lateral edges of the material to be unrolled.

The quantitative information of the oscillation or misalignment of the material unrolled from the roll can be used by the control system of the cutting machine arranged downstream of the unrolling device, in order to reposition the cutting area, or as an indication to the operator for a manual movement of the cutting area, with response times on the part of the operator which are therefore almost immediate.

Moreover, accurate control of the position of the material allows to reduce lateral waste margins, which normally take into account not only the selvage (region of lateral imperfection due to the production process and unsuitable for cutting) but also the possible oscillations of the alignment control system.

The device according to the invention further allows to detect automatically the lateral reference alignment between the edge of the unrolled material (for each material) and the cutting area without having to specify it manually for each material and also allows to detect automatically the position of the transverse edge of the material, i.e., the leading or trailing edge of the material (front or rear edge of said material).

The detection of the transverse edge of the material allows to determine the position of the front edge in relation to the cutting area of the cutting machine arranged downstream of the unrolling device. Moreover, it allows to detect the end of the roll and therefore the depletion of the material.

The detection of the position of both edges of the material allows to measure automatically and continuously the exact width of the material, which might differ from the stated or locally measured width, consequently adjusting the size of the area available for cutting, with an evident advantage in terms of saving material.

Moreover, the device according to the invention allows to use the measurement of the lateral movement thus obtained to correct the position of the roll, moving it therefore laterally until the detected misalignment or lateral movement is compensated.

This allows to correct substantially in real time the position of the roll so that the material unrolls without misalignments.

In practice it has been found that the unrolling device according to the invention fully achieves the intended aim and objects, since it allows to determine the exact position of at least one edge of the material unrolled from the roll, and optionally the position of both edges, determining quantitatively any movement or misalignment.

The device thus conceived is susceptible of numerous modifications and variations, all of which are within the scope of the appended claims.

In practice, the materials used, as well as the contingent shapes and dimensions, may be any according to requirements and to the state of the art.

The disclosures in Italian Patent Application No. MI2011A000911 from which this application claims priority are incorporated herein by reference.

The invention claimed is:

1. An unrolling device for materials in rolls, comprising means for unrolling a roll of material to be unrolled, further comprising means for detecting at least one lateral edge of the material unrolled from said roll which are adapted to detect quantitatively the movement of said edge transversely to the unrolling direction of the material, wherein said means for indicating the quantity of movement comprise a rod-like element which is pivoted at opposite ends of said synchronous conveyor belts or rollers, said rod-like element being provided, at least one region adapted to face said material unrolled from said roll, with a graduated scale, and wherein the means for detecting the at least one lateral edge is configured to detect the amount of lateral movement of the material based on the graduated scale.

2. The device according to claim 1, wherein said means for detecting the edge of the material unrolled from said roll comprise a plurality of photocells arranged at at least one of the edges of said material unrolled from said roll.

3. The device according to claim 2, wherein said means for detecting the edge of the material unrolled from said roll are arranged at each one of the lateral edges of said unrolled material.

4. The device according to claim 1, wherein said means for detecting the edge of the material comprise a vision system.

5. The device according to claim 1, wherein said means for detecting the lateral edge of the material unrolled from said roll are arranged at least one of shoulders for supporting synchronous conveyor belts or rollers, said material being unrolled from said roll and passing in front of said detection means.

6. The device according to claim 1, further comprising means for indicating a quantity of movement of the material unrolled from said roll, which are arranged mutually opposite with respect to said means for detecting the lateral edge, said material unrolled from said roll being unrolled between said detection means and said means for indicating the quantity of motion.

7. A method for controlling the misalignment of a material unrolled from a roll by means of an unrolling device according to claim 1, comprising the steps of:

detecting quantitatively, by said means for detecting at least one lateral edge of said material, the movement of said edge with respect to predefined unrolling direction;

on the basis of said quantitative movement detection, performing an operation for repositioning a cutting area defined on the unrolled material, so as to adapt said cutting area to the detected misalignment of said material, said repositioning operation comprising moving said cutting area onto said material taking into account the detected misalignment by compensating said detected misalignment with the movement of said cutting area.

8. The method according to claim 7, further comprising a step of detecting a transverse edge of said material unrolled from the roll.

* * * * *